US007743578B2

(12) United States Patent
Edmondson

(10) Patent No.: US 7,743,578 B2
(45) Date of Patent: Jun. 29, 2010

(54) SLOTTED METAL STUD WITH SUPPLEMENTAL FLANGES

(76) Inventor: Dennis L. Edmondson, P.O. Box 244, Marysville, WA (US) 98270

( * ) Notice: Subject to any disclaimer, the term of this patent is extended or adjusted under 35 U.S.C. 154(b) by 1354 days.

(21) Appl. No.: 10/937,644

(22) Filed: Sep. 9, 2004

(65) Prior Publication Data

US 2006/0048470 A1 Mar. 9, 2006

(51) Int. Cl.
*E04H 12/00* (2006.01)

(52) U.S. Cl. ..... 52/653.1

(58) Field of Classification Search ..... 52/653.1, 52/733.2, 733.3, 736.1, 731.9
See application file for complete search history.

(56) References Cited

U.S. PATENT DOCUMENTS 3,908,328 A * 9/1975 Nelsson ..... 52/769
4,152,873 A * 5/1979 Burke ..... 52/1
4,353,192 A * 10/1982 Pearson et al. ..... 52/281
4,435,936 A * 3/1984 Rutkowski ..... 52/481.1
4,693,047 A * 9/1987 Menchetti ..... 52/664
4,866,899 A * 9/1989 Houser ..... 52/481.1
5,216,859 A * 6/1993 Moreno et al. ..... 52/238.1
6,301,854 B1 10/2001 Daudet et al.
6,640,517 B2 * 11/2003 Mitchell ..... 52/736.1

* cited by examiner

*Primary Examiner*—Richard E Chilcot, Jr.
*Assistant Examiner*—Jessica Laux
(74) *Attorney, Agent, or Firm*—David L. Tingey

(57) ABSTRACT

A metal building stud having at least one supplemental flange extending from at least one slot in the stud web yielding a stud with increased strength, both compressive (longitudinally) and in shear (transverse). The slotted web presents a reduced web area through which heat or sound may be conducted and slots in which insulation is received, both increasing resistance to heat and sound transfer. Slots and supplemental flanges may also be provided in the stud primary flanges.

13 Claims, 16 Drawing Sheets

SLOTTED METAL STUD WITH SUPPLEMENTAL FLANGES

BACKGROUND

1. Field of the Invention

This invention relates to steel studs comprising parallel flanges extending orthogonally from web sides, and more particularly to a stud with at least one slot in the web and including supplemental flanges extending from slot sides within the web.

2. Prior Art

Interior wall construction using horizontal channel beams as headers and footers and matching vertical studs received into the channel beams is well-known. Commonly, the studs are also channel-shaped and both are made of metal, typically cold formed metal and, typically steel. Similarly, metal buildings employ girts (sidewall bracing) and perlins (roof bracing). Roof rafters, headers, footers, beams and joists can also employ channel shaped members. (For purposes herein, use of the term "stud," "metal stud," "steel stud" and "building stud" are not meant to be restrictive or limitations but are meant generically to be synonymous and to include all materials from which such studs may be formed.)

Of all modes of failure, buckling (Euler or local) is probably the most common and most catastrophic. That is, a structure may fail to support a load when a member in compression buckles, that is, moves laterally and shortens in length. A steel stud may be described for these purposes as a slender column where its length is much greater than its cross-section. Euler's equations show that there is a critical load for buckling of a slender column. With a large load exceeding the critical load, the least disturbance causes the column to bend sideways, as shown in the inserted diagram, which increases its bending moment. Because the bending moment increases with distance from a vertical axis, the slight bend quickly increases to an indefinitely large transverse displacement within the column; that is, it would buckle. This means that any buckling encourages further buckling and such failure becomes catastrophic.

The traditional steel stud construction comprises a pair of parallel flanges extending orthogonally from a web. Commonly the flange distal end bends inward slightly to increase the compressive stability converting the flat two-dimensional flange into a three dimensional structure. For these purposes, "compressive stability, strength or stress" means a reference value that measures the load a structure can sustain before it buckles or otherwise deforms and loses support for a load.

Such studs are very poor energy conservers. For example, for internal walls the metal stud acts as a thermal conduit and actually enhances thermal conductivity across the wall over wood and other materials. In metal buildings the studs (girts and perlins) are in direct metal-to-metal contact with the outside material sheeting and become conduits of heat on the outside sheeting to inside the building. Heat passes through the web, so one interested in reducing thermal conductive might consider removing material from the web to create slots in the web. To the extent such slots remove metal and thus reduce the thermal path, the stud is less conductive thermally. Also, such slots may receive insulation that further impede conductivity.

Similarly, a steel stud is a good acoustic conductor, which is detrimental in many applications. It has long been desired to reduce sound transmission through metal wall studs. As in thermal conductivity, re-shaping of a significant portion of the web or the flanges will reduce the acoustic conductivity of the stud and therefore the wall.

It is a primary object of the present invention to enhance the compressive stability, strength and bending resistance of a traditional steel stud. It is another object to reduce thermal conductivity and acoustical transmission, of the stud while enhancing the bending resistance and compressive stability and strength. To this end, it is a further object to introduce one or more slots in the stud web that interrupt conductivity across the web in combination with projections from the web at the slots additional to the primary flanges that enhance the load that a stud can support under bending and compression.

SUMMARY

These objects are achieved in a first embodiment in a building stud having at least one supplemental flange of a substantial I areal dimension extending from a side of a corresponding slot in the web. These objects are also achieved in a second embodiment in a building stud having a plurality of small holes punched in the stud leaving punched web or flange material projecting from the punched hole.

These supplemental flanges are formed by stamping out a flange in the web on three flange sides and then bending the supplemental flange away from the web on the fourth, uncut side, forming a slot in the web. The result then is a supplemental flange extending from the web at the slot edges. Typically, the supplemental flange usually extends normal to the web and parallel to the primary flanges extending from the web edges, although it can be angled from the web other than normal. The slot in the stud web presents a reduced web area through which heat or sound may be conducted.

The flange is formed as the slot is formed by cutting the web for the slot, dividing the intended slot area of the web into two equal side by side panels in the center and top and then folding the panels out from the plane of the web simultaneously forming the slot and a continuous supplemental flange. Alternatively, the slot area can be cut (stamped) with a U cut at the slot top and an inverted U at the slot bottom joined by a center cut between them. The top and bottom U panels are then folded outward to form horizontal supplemental flanges at the slot top and bottom and the side panels are folded out to form vertical supplemental flanges.

Rather than weaken the stud at the slot, the stud is in fact strengthened through a few mechanisms. First, the longitudinal extent of the web of a traditional stud presents a large vertical plane susceptible to local shear buckling under load that can lead to Euler bucking. Introducing slots having supplemental flanges into the web reduces that extent. That is, the Supplemental Flange Metal Stud ("SFMS") itself actually stiffens the web plane by creating smaller flat planes in the web plane than are present in standard steel studs thus increasing local shear buckling resistance.

The calculation discloses that for vertical loading the SFMS provides better stability in buckling resistance due to the center of gravity being moved away from the plane of the web toward the opening of the channel section. This effect distributes the vertical load more uniformly over the SFMS cross-sectional area; rather than mostly in the web as standard steel studs do; and thus forcing local buckling effects to require a higher vertical loading than standard steel studs can handle. The SFMS also enhances resistance to Euler buckling (long column lateral deflection) by the new properties the supplemental flanges provide. In short, for the stud to bend at the slot, both the supplemental and primary flanges orthogonal to the web must also bend, but with the supplemental flanges, there is increased resistance to that bending.

The supplemental flange can be either continuous (fully encompassing the slot) or discontinuous (not completely encompassing the slot) although the former will provide for greater strength and structural stability than the latter. When all the original material in a traditional metal stud remains in the final SFMS product, in the case of supplemental flanges extending from the full length of slot sides the SFMS retains more than the total cross-sectional area of the traditional stud, which retains its support for compressive loads and provides additional rigidity that equates to better stud stability than traditional steel studs. This is demonstrated in both the x-axis and y-axis bending calculations below.

Calculations confirm that adding the supplemental flange to the flange at the slot sides and ends not only fully offsets any loss of compressive strength caused by the slot but actually increases it over the unmodified stud without slots or supplemental flanges. That is, the stud can sustain a greater compressive, or longitudinal, or bending load with slots and supplemental flanges than without them. The following calculation is typical:

The following calculation assumes a 16 gauge "C"-Section Channel, 6"×2½" (0.0598" wall thickness) stud.

The strength of a load supporting column can be represented by the moment of inertia about the major axis, X-X, where buckling could occur first. When the moment reaches a high enough value, known as the Euler Buckling under load the column will buckle. This value is proportional to the moment of inertia, so the higher the moment of inertia, the more load the column will sustain before buckling.

The following equation calculates the moment of inertia ($in^4$) about the X-X axis for a channel cross-sectional area. The designated sections are as represented in FIG. 27.

$$I_{x\text{-}x} = 2(A_1 d_1^2) + 2(A_2 d_2^2) + 2\left(\frac{bh^3}{12}\right) + 2(A_3 d_3^2) + 2(A_4 d_4^2)$$

where h=0.0598 inch, the thickness of 16-gauge cold formed steel.

b=width of various sections. For the calculation of $I_{x\text{-}x}$, it will be determined from a central axis between the two widths, 2.50 inches, 1.00 inch, and perpendicular to the 0.375 inch dimension. For the calculation of $I_{y\text{-}y}$, it will be determined by an axis transverse to the two width dimensions, 2.50 inches, 1.00 inch, and parallel to 0.375 inch dimension.

d=distance (in) from the neutral axis to each centroid of an area "A", respectively.

The neutral axis is located at the centroid or center of gravity, CG, of the stud. It is determined using the equation, $$CG_{y\text{-}y}{}^{i} = yA_i/A_t$$

where $A_i$ represents the cross-sectional area of each area that makes up the total cross-sectional area, $A_t$.

TABLE 1

| Component | A, area ($in^2$) | y (in) | yA ($in^3$) |
|---|---|---|---|
| A-1 | 0.0598)(2.5( )2 = 0.2990 | 1.25 | 0.374 |
| A-2 | (0.0598)(1)2 = 0.1196 | 0.5 | 0.0598 |
| A-3 | (0.0598)(2)(2) = 0.2392 | 0.0299 | 0.0072 |
| A-4 | (0.0598)(0.375)2 = 0.0449 | 2.5 | 0.1123 |
| Totals | $A_t$ = 0.7027 | | $yA_i$ = 0.5533 |

Using the values in the Table 1 to compute CG, $CG_{y\text{-}y}$=yA/A=(0.5533)/(0.7027)=0.7868 inch from the inside face of web. With this information the values for $I_{x\text{-}x}$ and $I_{y\text{-}y}$ of the supplemental flange stud can be calculated.

$$I_{x\text{-}x} = 2(A_1 d_1^2) + 2(A_2 d_2^2) + 2\left(\frac{bh^3}{12}\right) + 2(A_3 d_3^2) + 2(A_4 d_4^2) =$$

$$2(0.0598)(2.5)(2.9701)^2 + 2(0.0598)(1.0)(1.0)^2 + 2\left(\frac{(0.0598)(2.0)^3}{12}\right) +$$

$$2(0.1196)(2)^2 + 2(0.0224)(2.8125)^2 = 4.15 - inch^4.$$

To determine the percentage increase in load that the stud with supplemental flanges can sustain, we next compute the moment of inertia about the major X-X axis of a standard steel stud (without the advantage of the supplemental flanges). Substituting the values as before.

$$I_{x\text{-}x} = \left(\frac{bh^3}{12}\right)_{SS} + 2Ad_{SS}^2 + 2\left(\frac{bh^3}{12}\right)_{SS} + 2Ad_{SS}^2 =$$

$$\left(\frac{0.0598(6.0)^3}{12}\right) + 2(0.0598)(2.5)(3.0)^2 + 2\left(\frac{0.0598(0.375)^3}{12}\right) +$$

$$2(0.0598)(0.375)(2.8125)^2 = 3.23 - inch^4.$$

The percentage improvement in the stud with supplemental flanges is [(4.15-3.23)/(4.15)](100), or 22.3% stronger than an equivalent Standard Steel Stud.

It has also been determined that resistance to local shear deflection of the stud is also enhanced for the slotted stud with supplemental flanges extending from the web at slot sides. That is, the stud with supplemental flanges also supports a greater lateral load, or a load placed intermediate a nonvertical stud directly on the web, on a slotted metal stud with supplemental flanges than on a metal stud without these features.

Though the stud is structurally enhanced by the supplemental flanges as discussed above, perhaps the most advantageous contribution of the supplemental flanges is that the web can be slotted without diminishing the structural integrity of the stud, and in fact providing an enhanced structure. The slots interrupt heat (and acoustical) flow through the web across the wall employing the stud. Prior to the described slotted stud with supplemental flanges, metal studs were disfavored because they are a poor insulator; in fact, they are a good insulator, defeating efforts for energy conservation and noise containment. Wood remained the preferred stud material because of the low conductivity of wood. The "R" factor for wood (fir, pine, and spruce) for a 2"×6" stud is 361 K/w. [1 W/mK=0.578 BTU/Hr-ft-° F.]. The "R" factor for a steel same-sized slotted stud is 846 K/W. The rate of heat loss through the wood stud is 0.055 W and through the slotted steel stud is 0.024 KIW, or less than half. The steel stud immediately becomes competitive and even advantageous. In addition, instead of air in the slot, which conveys heat by convection, insulation can be added. Typically, a wall of slotted studs as described is insulated with insulation foam filled between the studs. The foam is liquid when blown into the wall studded and flows through the slots into several areas between the studs. When the foam dries, the foam not only fills the area between and within the studs but the foam also remains through the stud slots, preventing air flow and consequent thermal transfer by convection as well as by conduction. The slotted stud enhanced structurally by the supplemental flanges and thermally by the slots and insulation in the slots thus becomes an attractive wall construction alternative.

It is clear that the open slot left in the SFMS that is created by the supplemental flange manufacturing process can vary in width and length depending on the requirements needed from the SFMS. Changes in this width and length will affect the various geometric properties It is recognized that drilling, shearing or punching of a metal sheet commonly causes a burr to protrude slightly from an edge of a hole or side that has been drilled, sheared or punched. This natural consequence of cutting metal is ignored for purposes herein and not included in use of the term "flange." Rather, use of the term "flange" for purposes herein is meant to define a broad structure projecting substantially from the metal sheet, generally planar typically, a distance significantly greater than a burr, which flange has been formed deliberately of substantial material, comparatively much greater that a burr resulting from cutting, for a structural purpose such us to give additional strength. As provided herein, another structural purpose of the flange is to substantially or significantly move the center of gravity of the stud away from the metal sheet (e.g., web) from which the flange extends, which is not accomplished by a burr. As shown in the figures, the flanges as the term is used herein typically comprise at least a major portion of the material removed to form the slot.

DETAILED DESCRIPTION OF THE PREFERRED EMBODIMENTS

Figure 1:
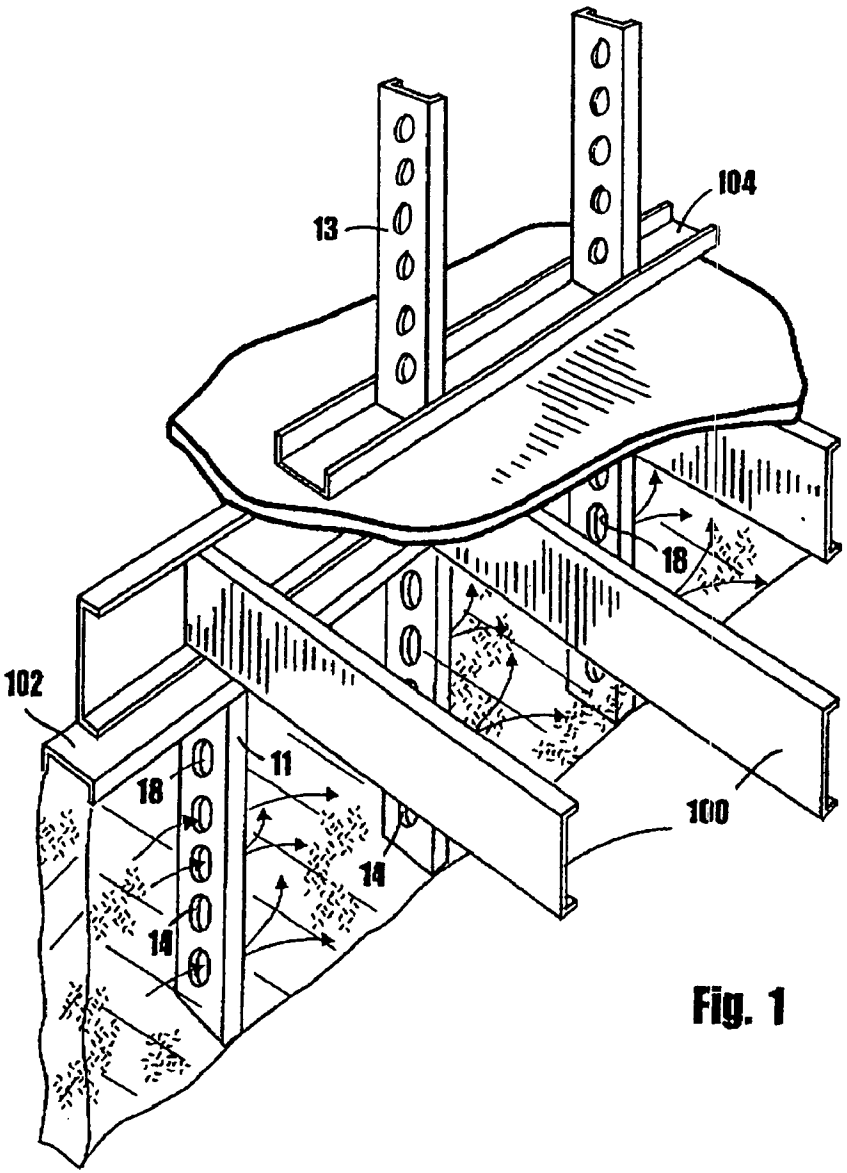
FIG. 1 is a perspective view of the metal stud slots longitudinal in the web and supplemental flanges extending from the slots sides, shown in a wall extending vertically between floor and ceiling joists.
Figure 2:
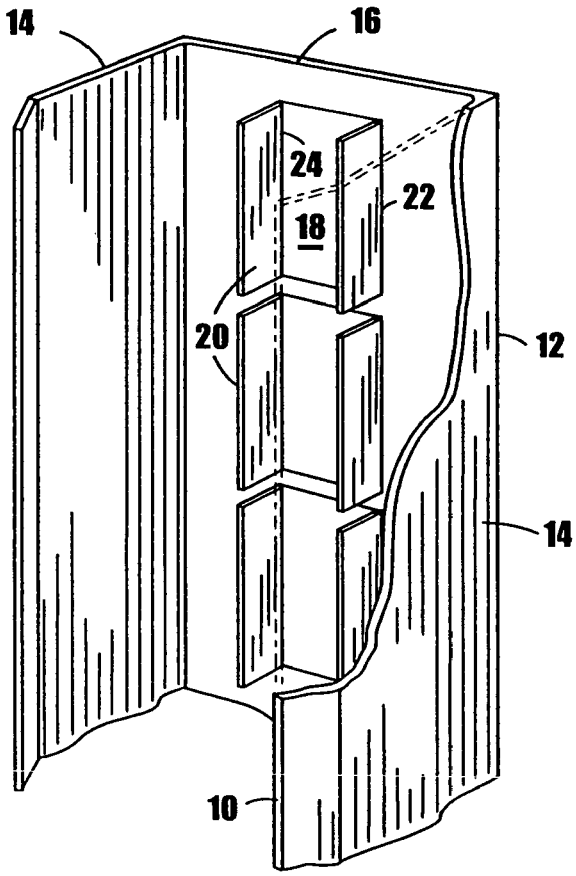
FIG. 2 is a rear perspective view of a metal stud with a slotted web having supplemental flanges extending inward from the web between stud parallel primary flanges.
Figure 3:
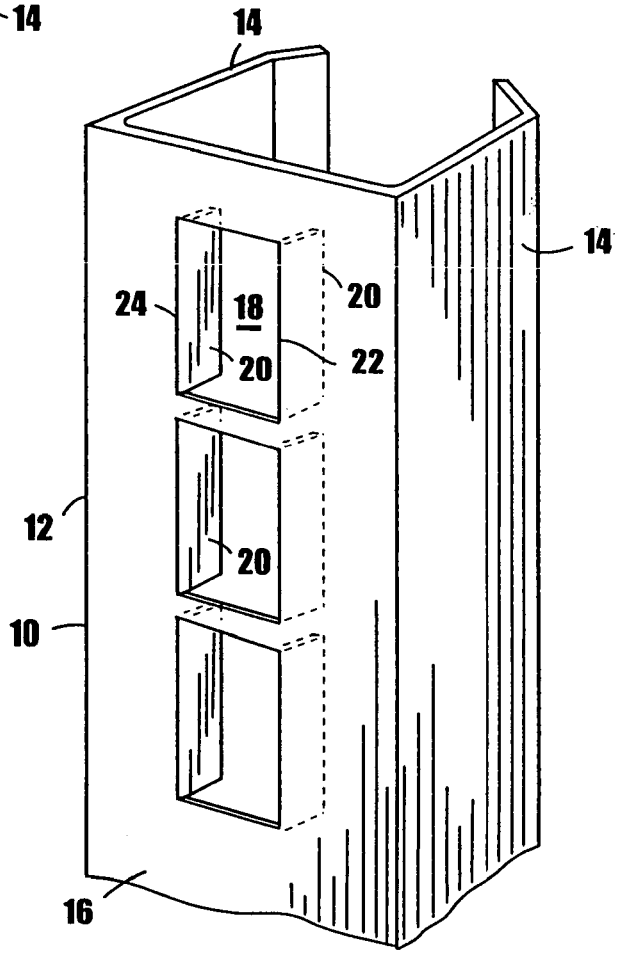
FIG. 3 is a front perspective view of a metal stud of FIG. 1.

The slotted metal stud 10 of the present invention is intended for use in conventional construction of stud walls. In the conventional manner of wall and building construction, a plurality of studs are spaced apart vertically in parallel between horizontal floor joists and ceiling joists 100. Typically, a channel stud header 102 connected to the ceiling joists 100 and opening downward receives upper ends 11 of the studs 10. Similarly, a channel stud footer 104 connected to the floor joists 100 and opening upward receives lower stud ends 13. Because the joists 100 are required to support a lateral, or transverse load, they are larger and stronger than the studs 10, which support a compressive, or longitudinal load. The longitudinal loading of a stud 10 with its unique vertical force distribution different from a joist 100 enables design variations consistent with that vertical loading, which design variations are not preferred for joists with joist lateral force distribution. The following therefore pertains uniquely to studs intended for vertical loading.

Figure 27:
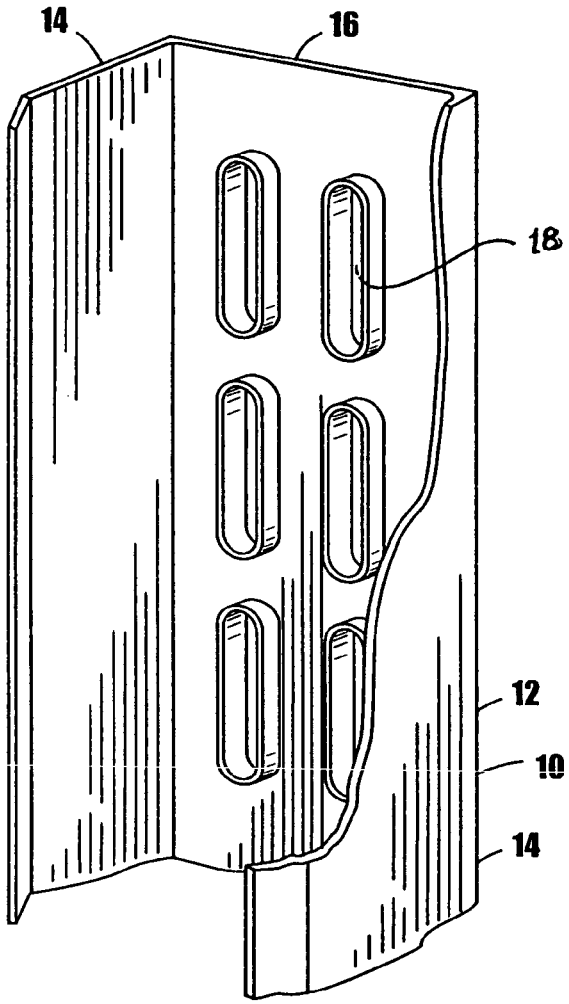
FIG. 27 is a rear perspective view of a metal stud showing a plurality of slots each with a supplemental flange continuous around the perimeter of each slot, the slots arrayed in two columns longitudinal in the web with a slot of one column adjacent a slot of the other columns.
Figure 28:
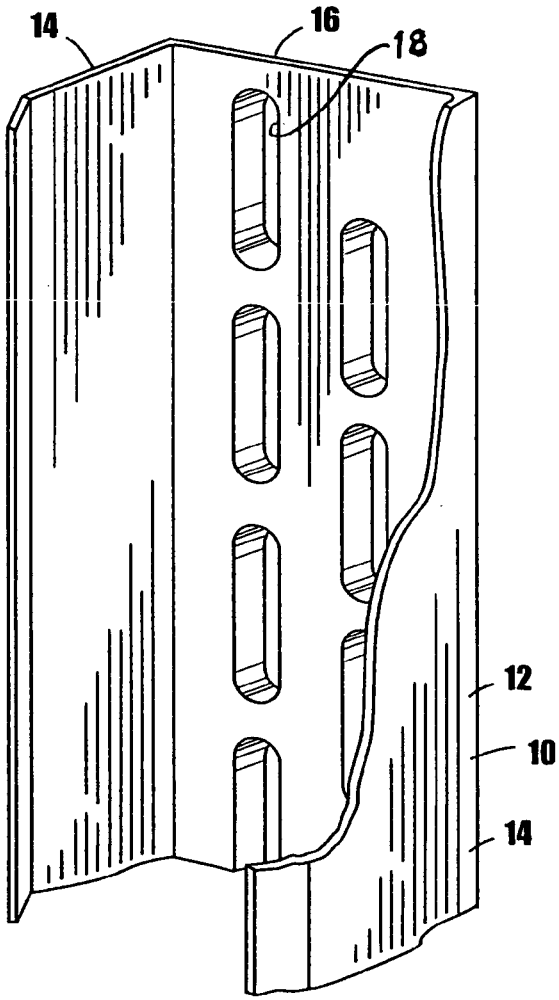
FIG. 28 is a rear perspective view of the stud of FIG. 27.
Figure 33:
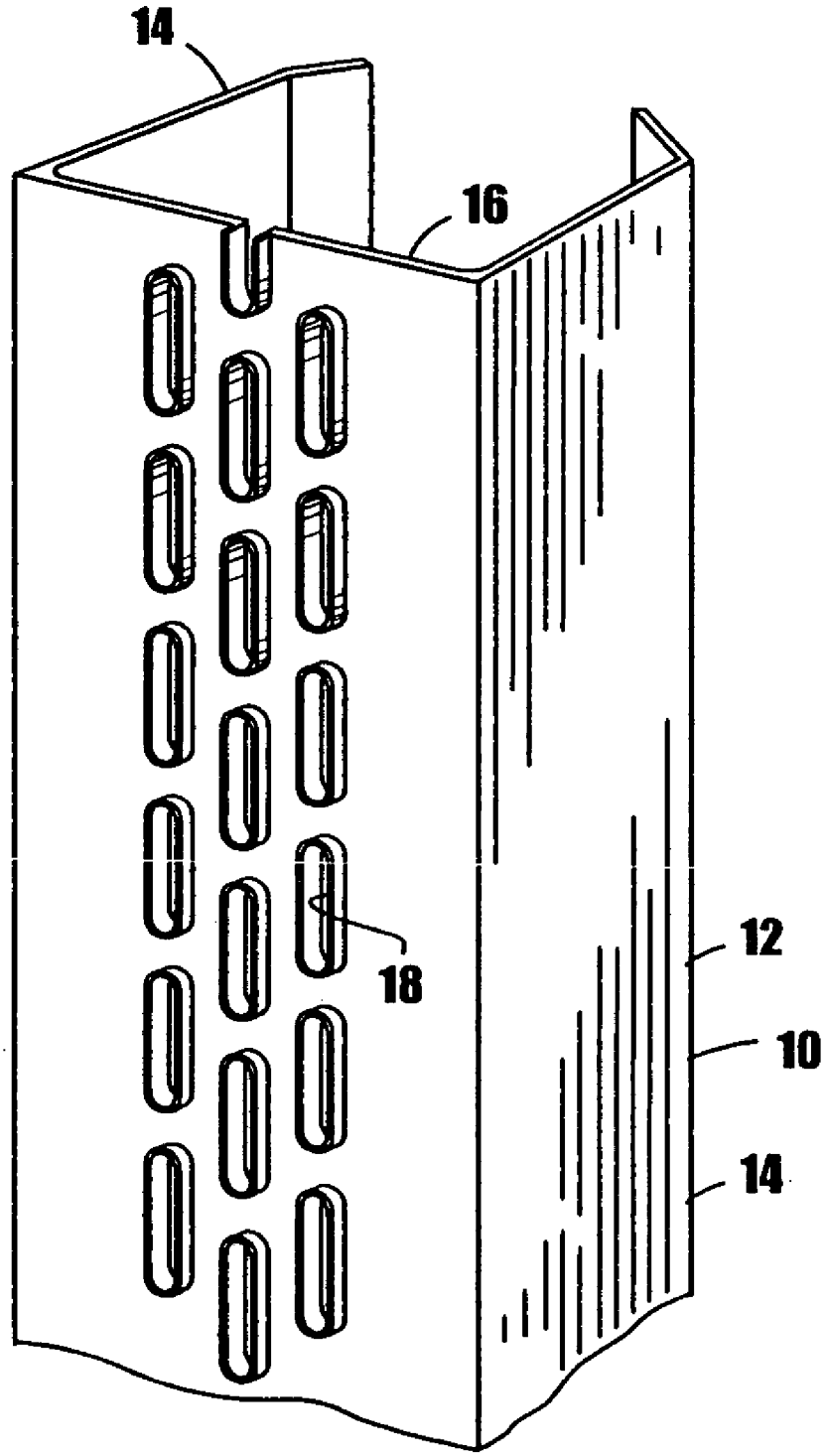
FIG. 33 is a perspective view of a metal stud shown with an array of slots, each slot having a supplemental flange continuous around the slot perimeter, the slots arranged in a plurality of columns longitudinal with the stud with slots of one column staggered from slots of an adjacent slot.

The stud 10 comprises a conventional C-shaped channel 12 including a single primary flange bending from and extending in a same single direction from each side of a web forming a C-shaped channel, therein comprising a pair of parallel primary flanges 14 extending a same extent and separated by a web 16. (For all purposes herein, "side of a web" or such other similar term is deemed to mean a lateral edge of a web and "same single direction" means the primary flange on each side of the web extends in a single direction from the web and is the same direction on both sides of web, thus defining the "C" shape of a straight back, or web and straight sides extending therefrom in a single and same direction, which could also be termed, "U-shaped." For these purposes, such a shape having a back with opposing sides extending therefrom will be termed "C-shaped.") In the preferred embodiment, the web 16 is unitary and a single piece wherein at least one and preferably a plurality of slots 18 are stamped in the web 16 such that at least one and preferably two supplemental flanges 20 bend out of the slot 18 from first and second slot sides 22, 23 bounding the slot 18 to extend inward, between and parallel to the primary flanges 14. In this manner, the supplemental flanges 14 comprise a substantial areal portion and typically a third, of the web 16 bending from the web to form the slot. The slots 18 may be arrayed in one or more columns 19. Preferably the supplemental flanges 20 respectively bend on vertical slot sides 22, 23 and extend substantially the vertical length of the slot. For these purposes, the vertical direction is longitudinal with the stud. Two or more columns 19 may be configured with slots 18 side by side in adjacent slot columns as in FIGS. 27, 28, and 33 or with slots 18' of one column 19' staggered between or overlapping slots 18' of an adjacent column 19".

Figure 26:
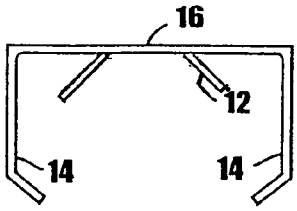
FIG. 26 is a top planar view of a stud with supplemental flanges extending inward from the web and then bending back toward the web.

Preferably, the supplemental flanges 20 are similar, symmetrically extending inward from the web 16 from said slot sides 22, 24. Thus, each supplemental flange 20 will be in length between its proximal end at the web to its distal end a distance equal to half of the width of the slot 18. (In a minor variation, the web 16 is stamped to form a slot 18 with a single supplemental flange 20' that bends inward from a slot side 22, 24, in which case the length of the supplemental flange 20' is the width of the slot 18.) Though the supplemental flange preferably extends orthogonally from the web, it can also extend from the web at any angle other than perpendicular to the web, as shown in FIG. 26.

Typically, the supplemental flanges 20 comprise a major portion, and even most of the web 16 bending inward between the primary flanges 14 forming the slot 18 and the supplemental flanges 20 therein substantially moving the stud cross sectional center of gravity away from the web 16 therein substantially transferring load support from the web 16 to the primary flanges 14. Thus, it is recognized that though the cross sectional center of gravity is away from the web because of the contribution of the primary flanges it is further moved away from the web a distance from the web greater than that of a C-shaped stud without supplemental flanges and a slotted web when the supplemental flanges 20 are bent from the web to their positions as supplemental flanges between the primary flanges. It follows that for a stud 10 with a plurality of such slots 18 and supplemental flanges, each slot with at least one supplemental flange 20 extending into the channel formed by the primary flanges and the web, the additional supplemental flanges function to locate the center of gravity in the channel 12 even further away from the web. In the preferred embodiment, a supplemental flange 20 extends from each side 22, 24 of a plurality of slots 18 all extending into the channel and preferably aligned vertically in the web 16 each thereby contributing to increase the distance of the center of gravity from the web maintaining symmetry in the stud 10 for uniform load support through the stud. In an alternative embodiment, a first supplemental flange 20' extends from the web 16 at a first slot side 22 of a first slot 18*a*, a second supplemental flange 21' extends inward from the web 16 at a second slot side 24 of a second slot 18*b*, the second slot 18*b* being adjacent said first slot 18*a*, a third supplemental flange 20" extends from the web at the first slot side 22 of a third slot 18*c*, the third slot 18*c* being adjacent the second slot 18*b*, and a fourth supplemental flange 21" extends inward from the web 16 at the second slot side 22 of a fourth slot 18*d* adjacent the third slot 18*c*, the fourth slot 18*d* being adjacent the third slot 18*c* such that the supplemental flanges 20', 21', 20", 21" for successive adjacent slots alternate between extension from first and second slot sides 22, 24. The alternating pattern continues through the web 16 such that there are the same number of supplemental flanges 20, 21 on each of the slots' first and second sides 22, 24. Thus configured, the supplemental flanges 20, which are all similar and all between the primary flanges 14, extend further away from the web 16, therein further moving the stud cross sectional center of gravity away from the web 16 more effectively transferring load support from the web 16 to the primary flanges 14.

In an further embodiment, the web 16 is stamped to form the described flanges 20 extending from slot sides 22, 24 and also to form flanges 20 bending from the slot top 26 and bottom 28 forming four supplemental flanges 30 bending from the slot perimeter extending therefrom either inward to or outward from the Although the preferred embodiment is for the supplemental flanges 20 to extend inward such that the stud center of gravity is moved inward the stud and away from the web 16, thereby transferring more of the stud support from the web 16 and onto the primary flanges 14, the supplemental flanges 20 may also bend outward, away from the stud 10. As discussed, there is a structural advantage to moving the center of gravity inward in that the load on the stud is better distributed to the flanges instead of mostly on the web. Similarly, there is also a structural advantage in having the supplementary flanges 20 outward from the web. As given above the primary component in the stud moment of inertia of primary consequence is the term, $I=b\,h^3/12$ where b is the stud base (web dimensional direction), and h is the height (flange directional direction). It is seen that increasing the height even a small amount dramatically increases the stud strength. Thus for a stud beginning with a 2-inch flange and increasing it by 2 inches by extending a supplemental flange outward from the web, the stud strength increases by a factor of $4^3/2^3$, or 64/8=8. It may also be advantageous for some supplemental flanges to bend inward and some outward.

Figure 4A:
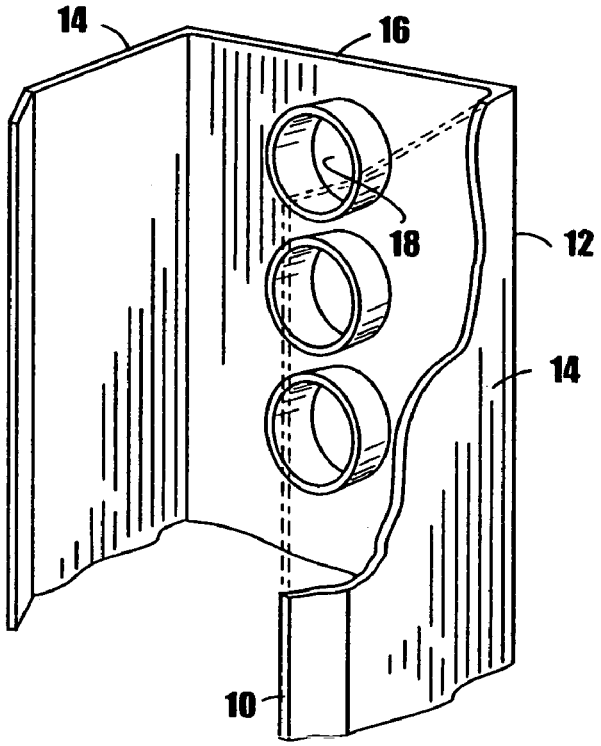
FIG. 4A-F are front views and rear perspective cut-away views of metal studs with a web with one or more slots aligned vertically in the web, the slots shown as circular or oblong shapes, each with a supplemental flange continuous around each slot perimeter.
Figure 4B:
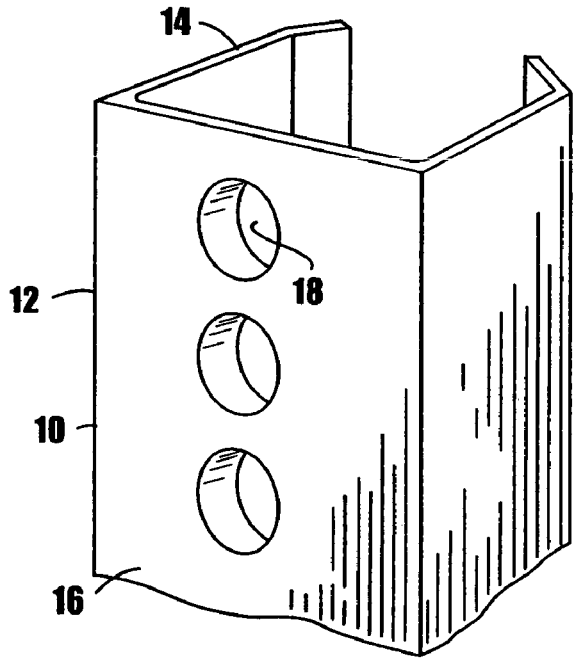
Figure 4C:
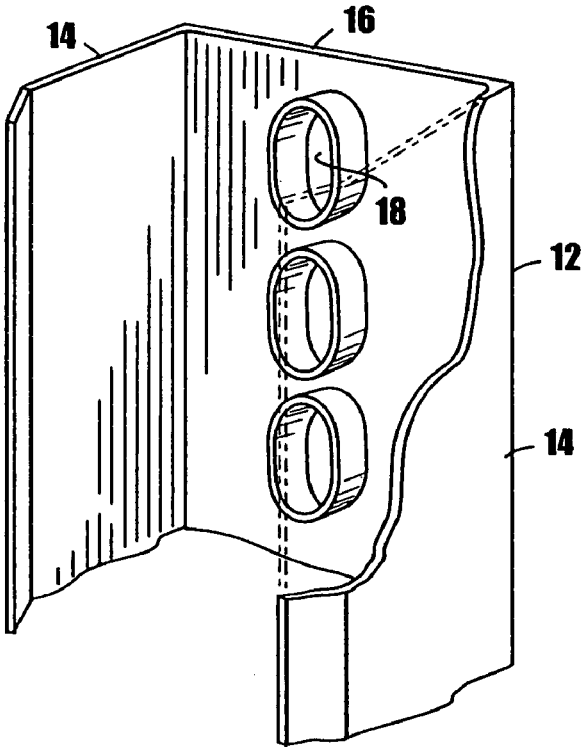
Figure 4D:
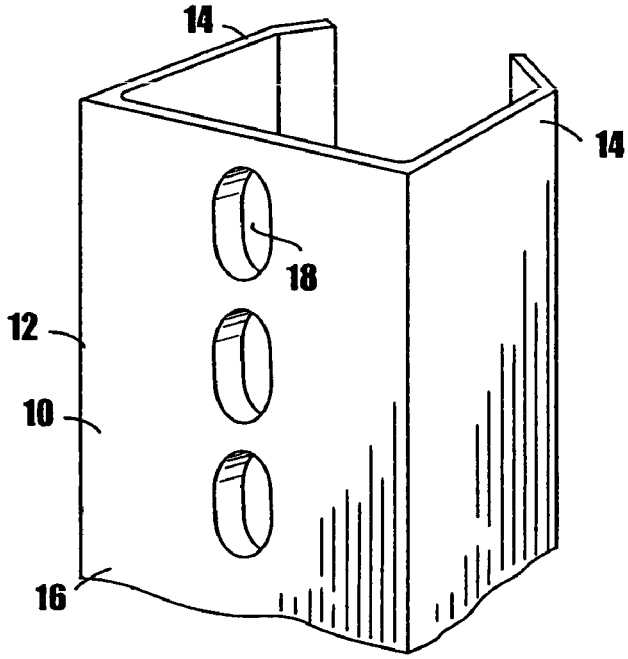
Figure 4E:
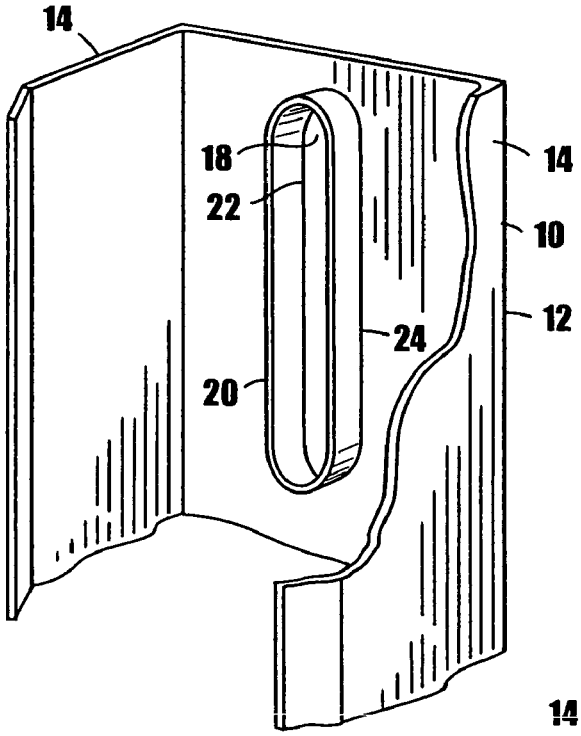
Figure 4F:
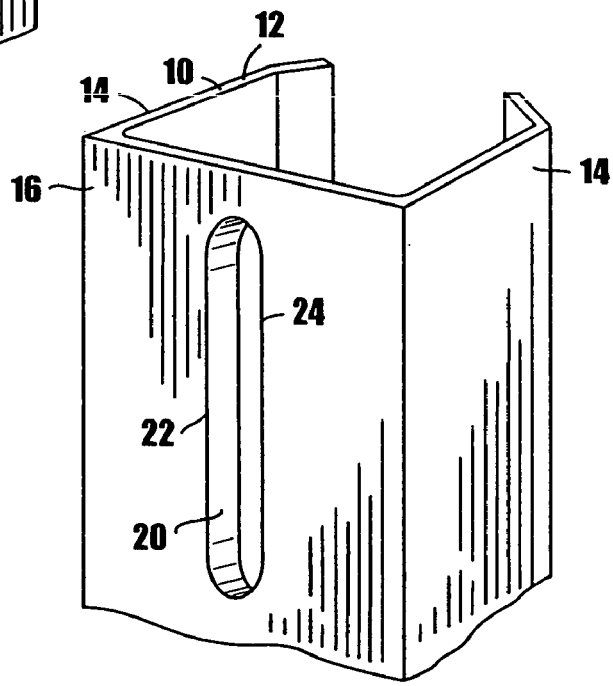
Figure 7:
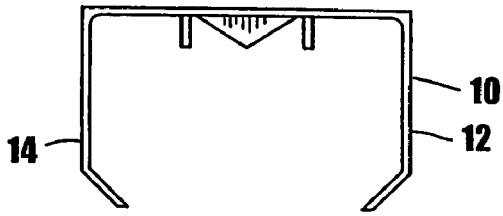
FIG. 7 is a top planar view of the metal stud of FIG. 5.
Figure 6:
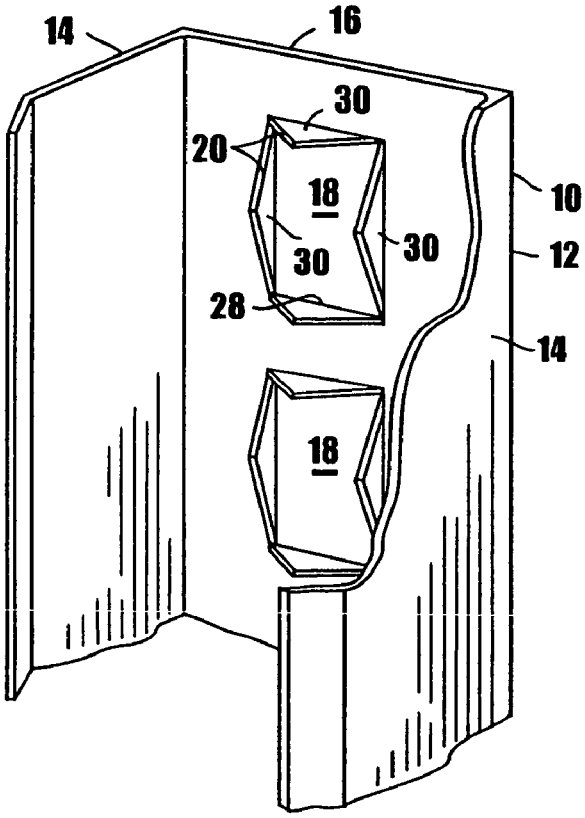
FIG. 6 is a rear perspective cut-away view of a metal stud of FIG. 5.
Figure 5:
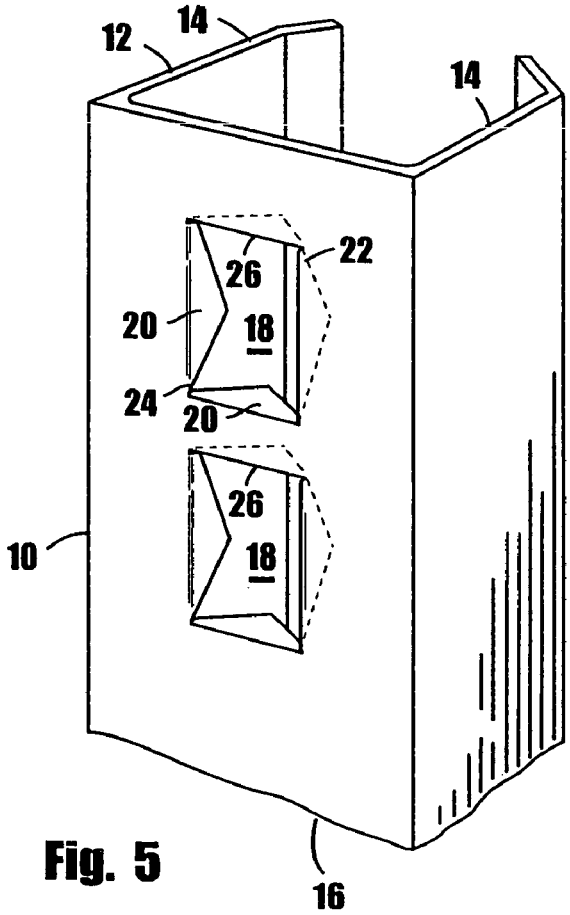
FIG. 5 is a front perspective view of a metal stud with a slotted web having supplemental flanges extending inward from sides, top and bottom of each of a plurality of slots in the web between stud parallel primary flanges.
Figure 10:
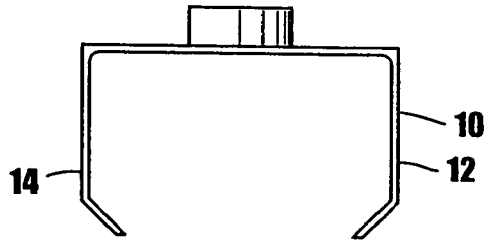
FIG. 10 is a top planar view of the metal stud of FIG. 8.
Figure 9:
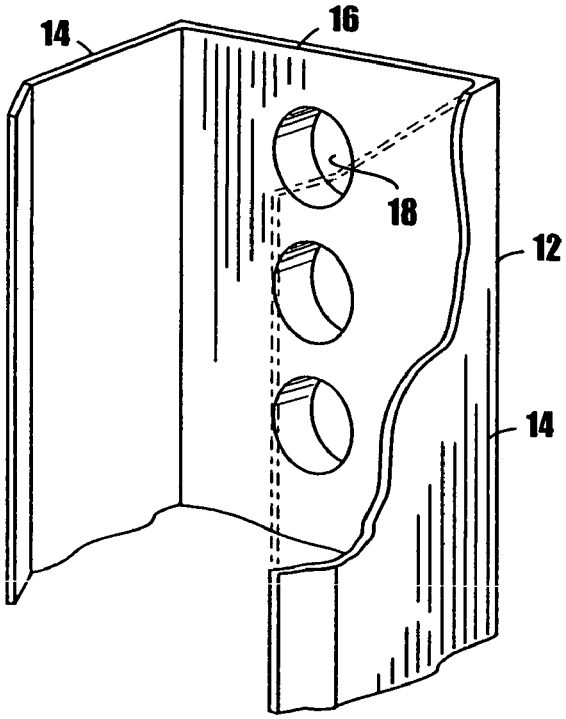
FIG. 9 is a rear perspective view of a metal stud of FIG. 8.
Figure 8:
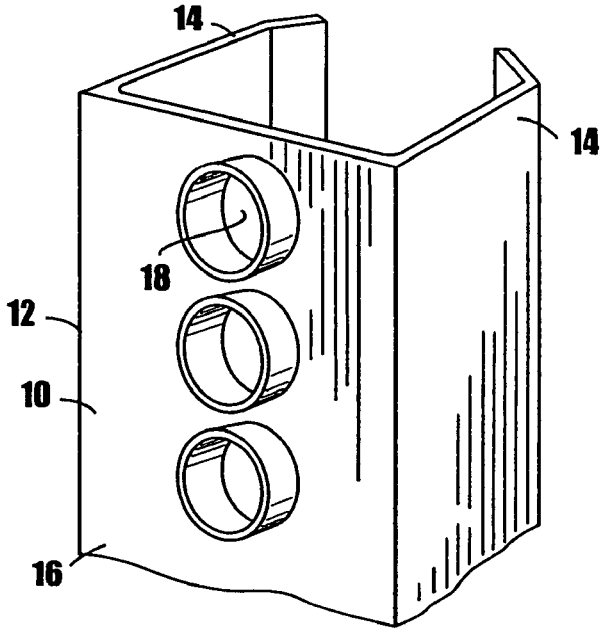
FIG. 8 is a front perspective view of a metal stud with a slotted web having supplemental flanges extending outward from sides each of a plurality of slots in the web.
Figure 13:
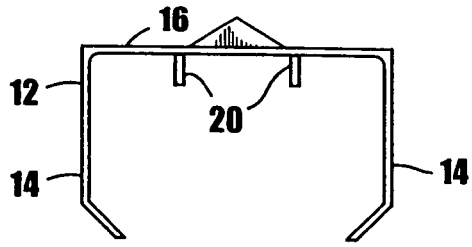
FIG. 13 is a top planar view of the metal stud of FIG. 11.
Figure 12:
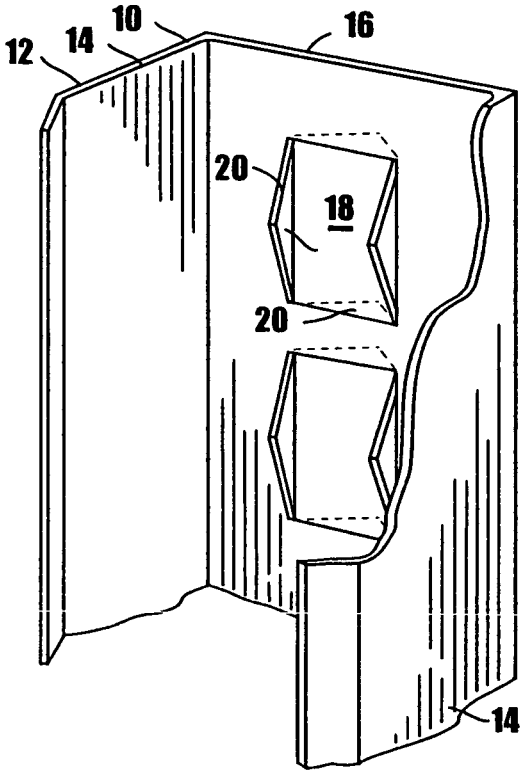
FIG. 12 is a rear perspective view of a metal stud of FIG. 11.
Figure 11:
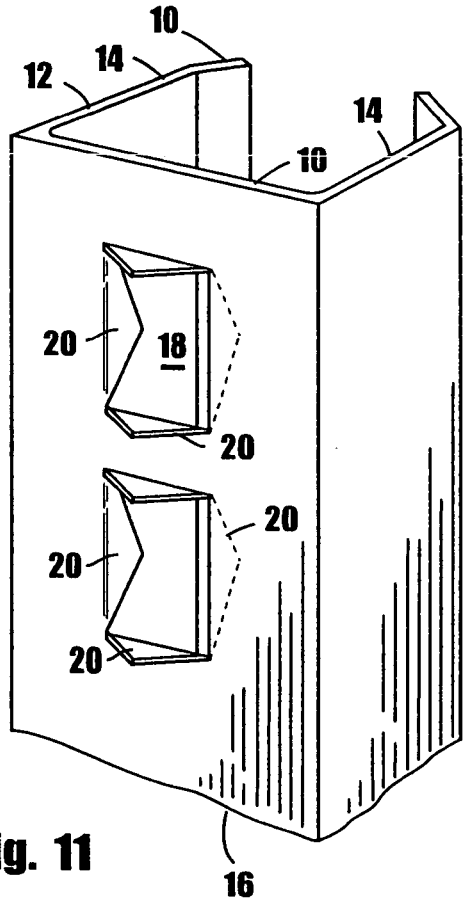
FIG. 11 is a front perspective view of a metal stud with a slotted web having supplemental flanges extending inward from sides and outward from top and bottom of each of a plurality of slots in the web.
Figure 14:
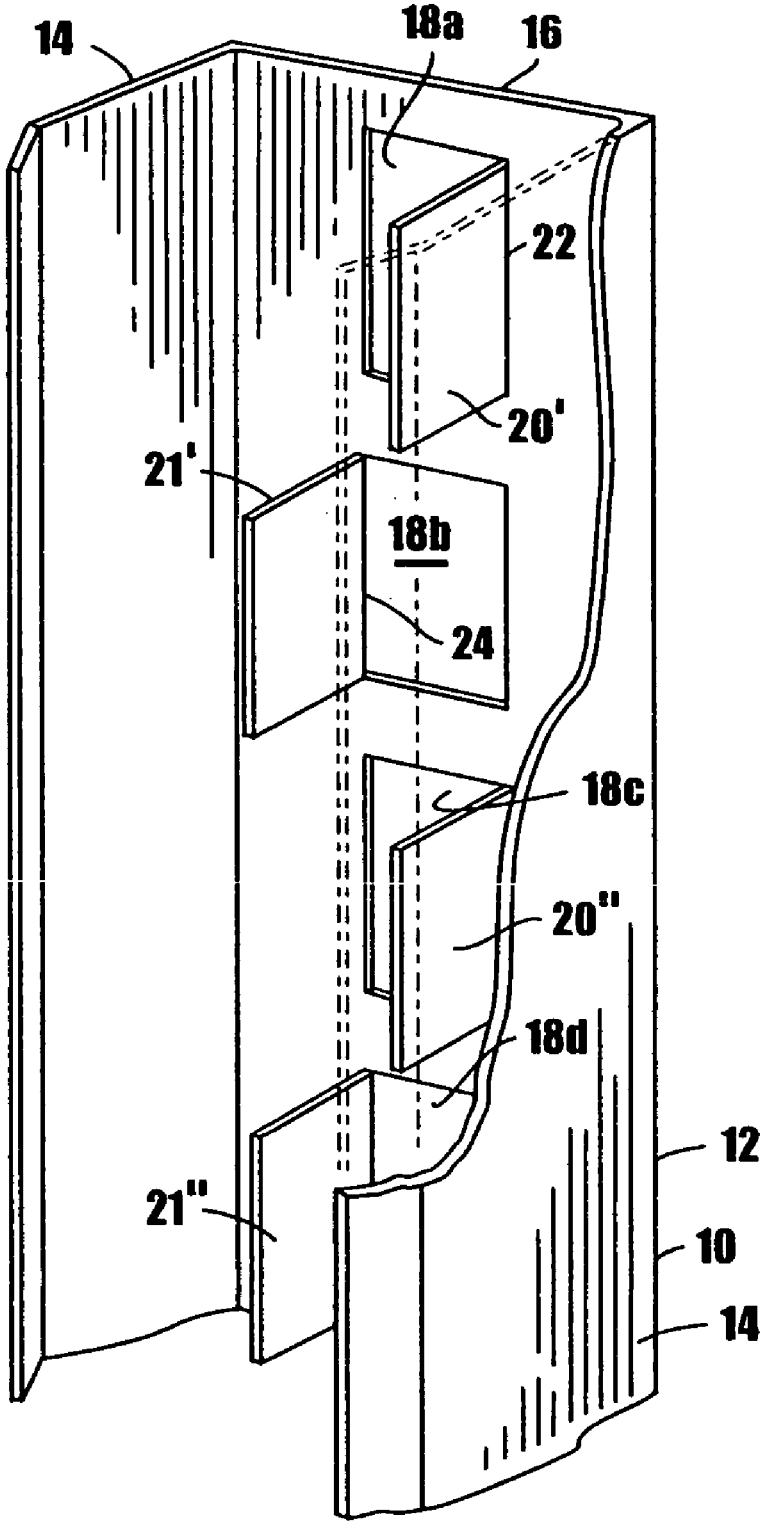
FIG. 14 is a rear perspective view of a metal stud with a web with a plurality of slots aligned vertically in the web, each having a single supplemental flange extending inward from the web between stud parallel primary flanges, the supplemental flanges alternating between first and second slot sides for successive adjacent slots.
Figure 17:
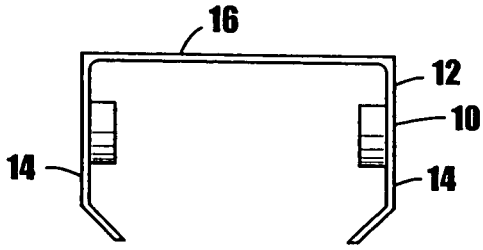
FIG. 17 is a top planar view of the metal stud of FIG. 15.
Figure 15:
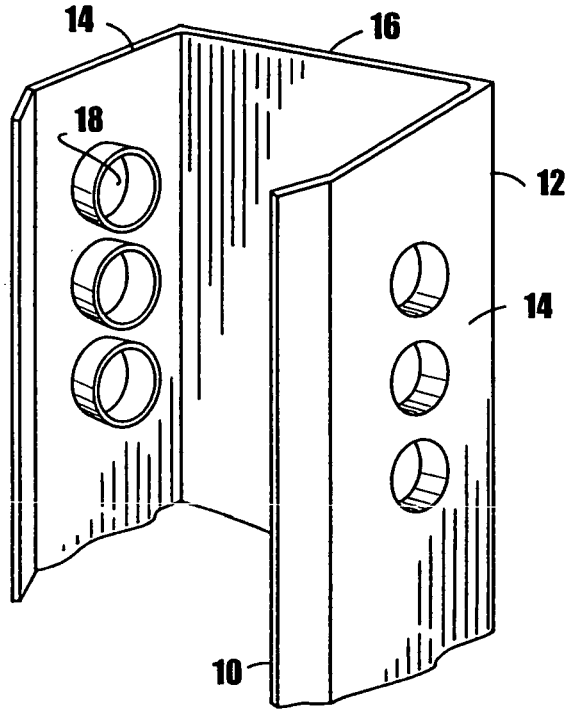
FIG. 15 is a rear perspective view of a metal stud with a slotted web having supplemental flanges extending inward from primary flanges.
Figure 16:
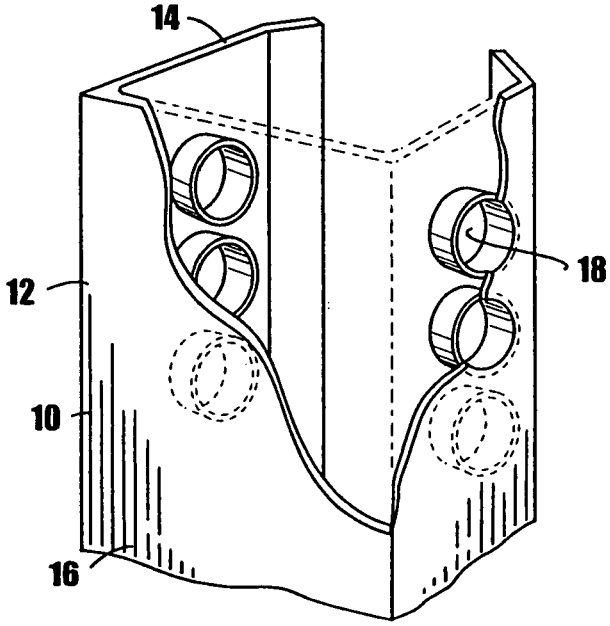
FIG. 16 is a front perspective view of a metal stud of FIG. 15.
Figure 18:
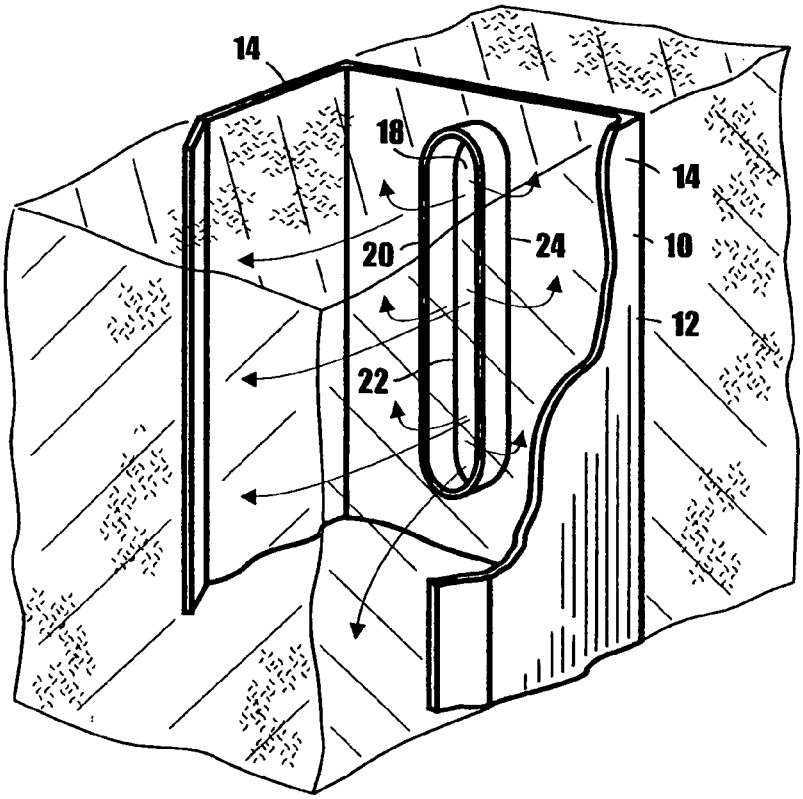
FIG. 18 is a rear cut-way perspective view of the slotted stud of FIG. 4E shown with insulation filling the stud and passing through the slot and passing beyond the stud as between studs in a wall.
Figure 19:
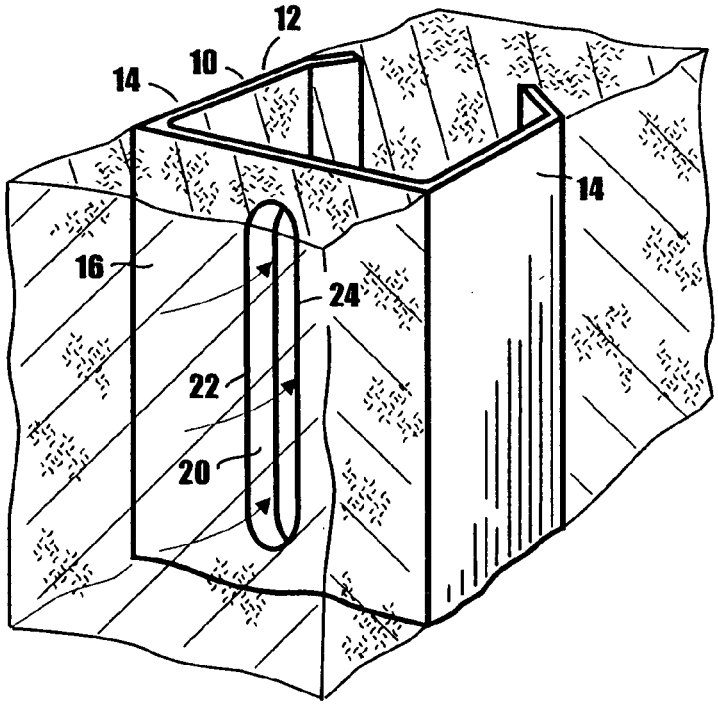
FIG. 19 is a front perspective view of the stud with insulation of FIG. 18.
Figure 22:
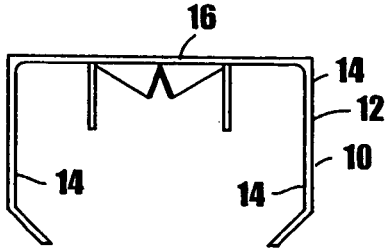
FIG. 22 is a top planar view of the metal stud of FIG. 20.
Figure 21:
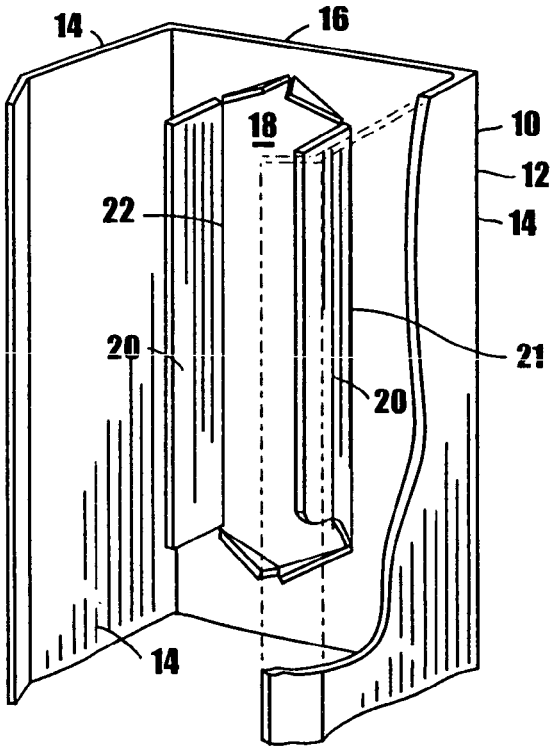
FIG. 21 is a rear perspective view of a metal stud of FIG. 20.
Figure 20:
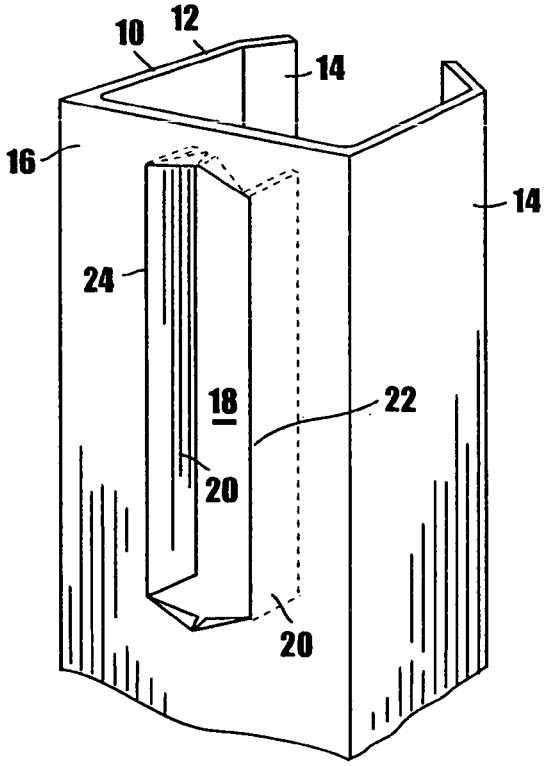
FIG. 20 is a front perspective view of a metal stud with a slotted web having supplemental flanges extending inward from the web, the slot further having triangular ends with additional supplemental flanges extending from the triangle sides of those ends.
Figure 25:
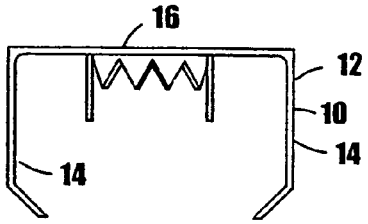
FIG. 25 is a top planar view of the metal stud of FIG. 23.
Figure 24:
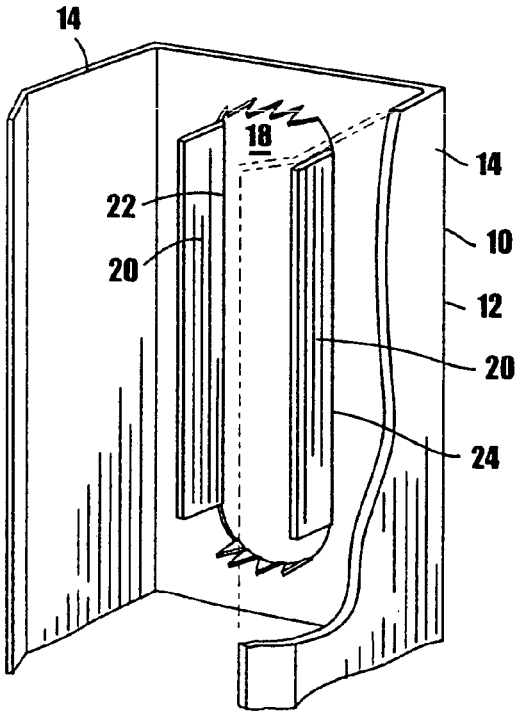
FIG. 24 is a rear perspective view of a metal stud of FIG. 23.
Figure 23:
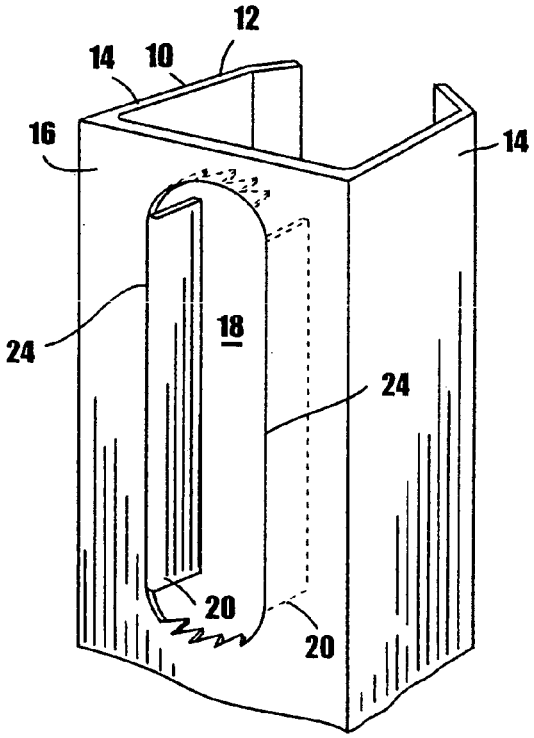
FIG. 23 is a front perspective view of a metal stud with a slotted web having supplemental flanges extending inward from the web, the slot further having semicircular ends with additional supplemental flanges extending from the those semicircular ends.

In the preferred embodiments, the slot is a rectangular and supplemental flanges 20 extend from the slot 18 either vertically, parallel with the primary flanges, or horizontal, orthogonally to the primary flanges 14. However, other variations in slot shape are deemed included in the invention. For example, the slot ends (top and/or bottom) may be of triangular shape each with two supplemental flanges bent and extending from the legs of the triangle as shown in FIG. 20-22. Similarly, the slot top and/or bottom may be curvilinear, such as shown in FIG. 23-25 as a semicircle, with a plurality of relatively small supplemental flanges extending from the slot ends. Alternatively, the slot may be punched out its center to produce a continuous and uninterrupted supplemental flange around an oval slot as shown in FIG. 4E. In a further embodiment, the stud 10 may comprise one or more slots 18 in one or both primary flanges 14 with one or more supplemental flanges 20 extending into the stud 10 as shown in FIG. 17-19. The illustration shows a single supplemental flange 20 extending from a slot top 32 , representative of the various alternative configurations of flanges extending from slot top, bottom or sides or a combination of the slot top, bottom or sides as described above for web based supplemental flanges, all of which are deemed included in this invention.

With the supplemental flanges 20 formed out of the web 16 from web material removed and folded from the web 14 to form the slots 18, the amount of stud material remains unchanged from a traditional metal stud. Thus, the dimensions of the supplemental flanges in the various configurations described above are defined by the dimensions of the slot from which it bends. That is, two supplemental flanges extending from the two slot sides may each be half the width of the slot. If there are flanges extending from respective ends of a rectangular slot, the side supplemental flanges are reduced in length equal to the sum of the extent of the top and bottom supplemental flanges. In maintaining the same amount of material in the stud, the stud does not reduce in support strength but in fact increases in support strength as calculated above.

Figure 30:
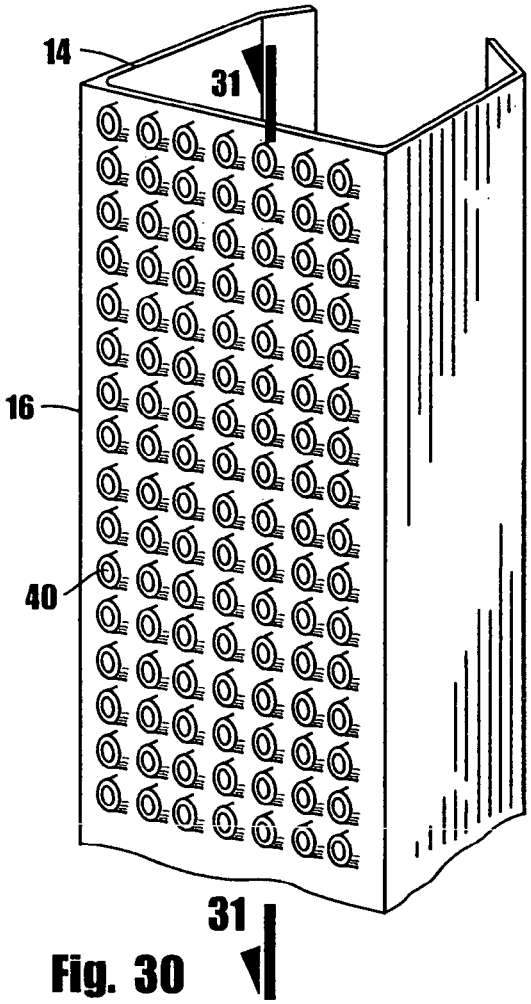
FIG. 30 is a front perspective view of a metal stud showing an array of holes punched through a web forming projections from the web around the holes.
Figure 31:
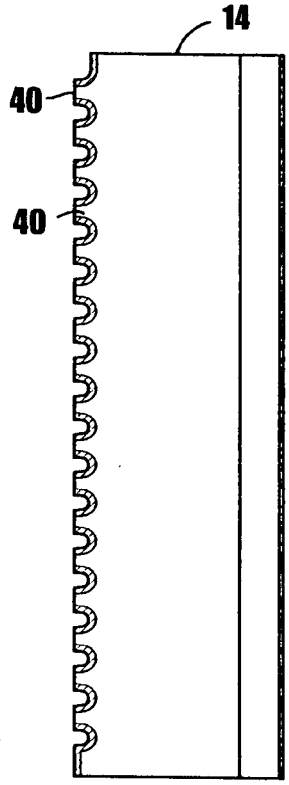
FIG. 31 is a cross-section view of the metal stud of FIG. 30 through the view line 31 shown in FIG. 30.
Figure 32:
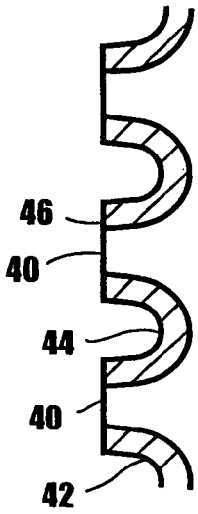
FIG. 32 an enlarged side view a section of the slots of FIG. 31.

In a still further embodiment shown in FIG. 30-32, the slots 18 comprise a plurality of holes punched through the primary flanges 14 or the web 16, or both, resulting in an array of quasi-conical holes 40 extruding from said primary flanges 14 or web 16. The figures show the supplemental flanges 14 punched outward for illustrative purposes; however, it should be understood that supplemental flanges punched inward are deemed included in the embodiments of the invention. For these purposes, the term quasi-conical hole means a hole with material from said flanges or web extruded from said flange or web about the hole as characteristically results when a hole is punched through a metal sheet, with a concave curvilinear circumferential side 42 narrowing from a base 44 at the flange or web to the hole perimeter 46 separated from that flange or web by its side 42 giving an appearance of a symmetrical volcano shape.

Figure 29:
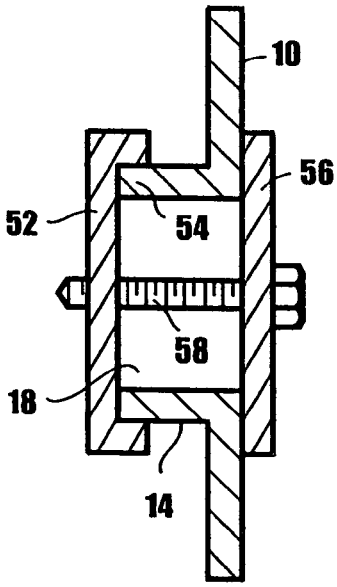
FIG. 29 is a cross sectional side view of a slot with supplemental flange showing a clip channel over supplemental flange distal ends and secured thereto by a screw passing through a clip plate bridging the slot, the screw threaded into a hole in the clip channel.

The stud 10 may be further strengthened by connecting supplemental flanges with a clip 50 to effect a mechanical load transference across a slot 18, as shown in FIG. 29. Typically, a U-shaped clip channel 52 fits over distal ends 54 of two supplemental flanges 14 extending from opposite slot sides. As shown, a clip plate 56 across the slot 18 is tightened to the clip channel 52 by a threaded screw 58 threaded into a hole 60 in the clip channel 52. The clip advantageously is of material with minimal thermally and acoustically conductivity.

Several figures have been provided as illustrative of various embodiments of the invention. The figures are for illustrative purposes only and not as limitations of the invention. A feature illustrated on one figure can be implemented in another configuration or in combination with another configuration. For example, an array of circular slots are deemed to include all possible shapes of slots in an array configuration and not limited to circular slots. Similarly, a figure may show a slot shape with a supplemental flange extending inward from the web or a primary flange and another slot shape or supplemental flange in the same or an alternative configuration extending outward from the web. It should be understood that any slot or supplemental flange shape may be configured to extend inward or outward or in any configuration represented as a feature in another figure by another shape.

The invention claimed is:

1. A building structure comprising a plurality of horizontal parallel joists and a plurality of vertical parallel metal load bearing studs disposed orthogonal to the joists, the studs comprising a single primary flange bending from and extending in a same single direction from each side of a web forming a C-shaped channel, the improvement comprising said web of said stud with a slot intermediate the web and at least two supplemental flanges extending respectively from at least two sides of said slot into the channel between the primary flanges such that a cross sectional center of gravity for the slotted stud with said at least two supplemental flanges is in the channel a distance away from the web greater than that of a C-shaped stud without said at least two supplemental flanges and a slotted web, the at least two supplemental flanges comprising a portion of the web separated and bent away from the web on said at least two sides of said slot resulting in an opening in the web which opening forms the whole or substantially the whole of said slot wherein all or substantially all supplemental flanges that extend from a slot side extend into the channel and wherein the at least two supplemental flanges comprise a first and a second supplemental flange extending from respective first and second vertical sides of said slot into the channel.

2. The building structure of claim 1 wherein said web of said stud is a unitary single piece.

3. The building stud of claim 1 wherein said supplemental flanges respectively bending on vertical slot sides extend substantially the entire vertical length of the slot.

4. The building structure of claim 1 wherein said at least one substantially transverse flange extending from the web at at least one slot end.

5. A building stud comprising a single primary flange bending from and extending in a same single direction from each side of a web forming a C-shaped channel, the web having at least one slot, at least two supplemental flanges extending respectively from at least two sides of said at least one slot into the channel, wherein each of said at least two supplemental flanges comprises a portion of the web bent inward between the primary flanges on said at least two sides therein moving the stud cross sectional center of gravity away from the web such that a cross sectional center of gravity for the slotted stud with said supplemental flanges is a distance from the web greater than that of a C-shaped stud without supplemental flanges and a slotted web and resulting in an opening in the web which opening forms the whole or substantially the whole of said at least one slot, and wherein the at least two supplemental flanges comprise a first and a second supplemental flange extending from respective first and second vertical sides of said at least one slot into the channel, and wherein all or substantially all supplemental flanges extending from a slot side extend into the channel.

6. The building stud of claim 5 wherein said at least two supplemental flanges further comprises at least one substantially transverse flange extending from the web at at least one slot end.

7. The building stud of claim 5 wherein said at least one slot and said at least two supplemental flanges comprise a plurality of said at least one slot and a plurality of said at least two supplemental flanges with said at least two supplemental flanges extending into said channel from each vertical side of each at least one slot of said plurality of at least one slot respectively, wherein said plurality of said at least one slot comprise all or substantially all slots in the web having supplemental flanges extending therefrom, said all or substantially all slots being arranged-longitudinally through the web.

8. The building stud of claim 5 wherein said at least one slot comprises a plurality of said at least one slot in the web and wherein said at least two supplemental flanges comprise a plurality of said at least two supplemental flanges extending into the channel from each vertical side of each at least one slot of said plurality of at least one slot respectively, and wherein said plurality of said at least two supplemental flanges comprises a portion of the web bent inward between the primary flanges therein moving the stud cross sectional center of gravity away from the web such that said cross sectional center of gravity for the slotted stud with said plurality of supplemental flanges is a distance from the web greater than that of a C-shaped stud without supplemental flanges and a slotted web, said portion of the web forming the plurality of said at least two supplemental flanges resulting in an opening in the web which opening forms the whole or substantially the whole of said at least one slot.

9. The building stud of claim 5 wherein said web of said stud is a unitary single piece.

10. The building stud of claim 5 wherein said supplemental flanges respectively bending on vertical slot sides extend substantially the entire vertical length of the slot.

11. The building stud of claim 5 wherein said at least two supplemental flanges further comprises at least one substantially transverse flange extending from the web at at least one slot end;

wherein said at least one slot and said at least two supplemental flanges comprise a plurality of said at least one slot and a plurality of said at least two supplemental flanges with said at least two supplemental flanges extending into said channel from each vertical side of each of said plurality of at least one slot respectively;

wherein said plurality of said at least one slot comprise all or substantially all slots in the web having supplemental flanges extending therefrom, said all or substantially all slots being arranged-longitudinally through the web;

wherein said plurality of said at least two supplemental flanges comprises a portion of the web bent inward between the primary flanges therein moving the stud cross sectional center of gravity away from the web such that said cross sectional center of gravity for the slotted stud with said plurality of supplemental flanges is a distance from the web greater than that of a C-shaped stud without supplemental flanges and a slotted web, said portion of the web forming the plurality of said at least two supplemental flanges resulting in an opening in the web which opening forms the whole or substantially the whole of said at least one slot; and wherein said web of said stud is a unitary single piece.

12. The method of increasing the compressive stability, strength and bending resistance of a C-shaped metal stud formed by a pair of primary flanges respectively extending in a same single direction from each side of a web forming a C-shaped channel comprising the following steps:

(1) Partially cutting at least two supplemental flanges from the web forming the whole or substantially the whole of a slot in the web such that one of the at least two supplemental flanges extends from each vertical side of the slot, respectively;

(2) Bending said one of the at least two flanges from said each vertical side of the slot inward between the primary flanges wherein each of said supplemental flanges comprises a portion of the web bent inward between the primary flanges such that said cross sectional center of gravity for the slotted stud with said at least two supplemental flanges is a distance from the web greater than that of a C-shaped stud without said at least two supplemental flanges wherein all or substantially all supplemental flanges extend from a slot side into the channel.

13. the method of claim 12 wherein said bending results in an opening in the web which opening forms the whole or substantially the whole of said first slot.

* * * * *